US007311651B2

(12) United States Patent
Stäb

(10) Patent No.: US 7,311,651 B2
(45) Date of Patent: Dec. 25, 2007

(54) TRANSPORT DEVICE

(75) Inventor: Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 193 days.

(21) Appl. No.: 10/505,873

(22) PCT Filed: Feb. 28, 2003

(86) PCT No.: PCT/DE03/00674

§ 371 (c)(1),
(2), (4) Date: Sep. 3, 2004

(87) PCT Pub. No.: WO03/074400

PCT Pub. Date: Sep. 12, 2003

(65) Prior Publication Data

US 2005/0107234 A1 May 19, 2005

(30) Foreign Application Priority Data

Mar. 4, 2002 (DE) ..... 102 09 213

(51) Int. Cl.
*B31F 1/08* (2006.01)

(52) U.S. Cl. ..... 493/428; 493/432

(58) Field of Classification Search ..... 493/428, 493/432, 422, 436, 424
See application file for complete search history.

(56) References Cited

U.S. PATENT DOCUMENTS

| | | | | |
|---|---|---|---|---|
| 730,892 | A | 6/1903 | Evensen | |
| 1,798,910 | A | 3/1931 | Smith | |
| 3,727,909 | A * | 4/1973 | Greiner et al. | 493/428 |
| 4,445,881 | A | 5/1984 | Bullen et al. | |
| 4,519,597 | A * | 5/1985 | DeSanto | 270/42 |
| 4,754,959 | A | 7/1988 | Kobler et al. | |
| 4,895,356 | A * | 1/1990 | Rudolf | 270/49 |
| 5,037,365 | A | 8/1991 | Breton | |
| 5,230,268 | A | 7/1993 | Richter | |
| 5,494,270 | A * | 2/1996 | Laubscher | 270/49 |
| 5,503,071 | A | 4/1996 | Hillebrand et al. | |
| 5,503,379 | A | 4/1996 | Michalik et al. | |
| 5,547,452 | A * | 8/1996 | Kepert et al. | 493/427 |
| 5,765,459 | A | 6/1998 | Hillebrand | |
| 5,839,343 | A | 11/1998 | Michalik et al. | |
| 5,921,906 | A | 7/1999 | Nagano | |
| 6,093,139 | A * | 7/2000 | Belanger | 493/353 |
| 6,551,227 | B1 * | 4/2003 | Whitten | 493/356 |
| 6,740,024 | B2 * | 5/2004 | Kitai et al. | 493/428 |
| 6,902,519 | B2 * | 6/2005 | Ochsner et al. | 493/428 |

FOREIGN PATENT DOCUMENTS

| | | |
|---|---|---|
| AT | 222671 | 8/1962 |
| CH | 278305 | 10/1951 |

(Continued)

*Primary Examiner*—Sameh H. Tawfik
(74) *Attorney, Agent, or Firm*—Jones Tullar Cooper, PC

(57) ABSTRACT

A transport or conveying device is used in a folding apparatus for transporting or conveying signatures. A transport or conveying cylinder, which carries the signatures, is placed in cooperative engagement with another cylinder. A position of a terminal end of a signature carried on the transport or conveying cylinder can be altered. The other cylinder that cooperates with the transport or conveying cylinder includes devices that press on the signature and that displace the end of the signature.

9 Claims, 7 Drawing Sheets

FOREIGN PATENT DOCUMENTS

| | | |
|---|---|---|
| DE | 2805643 | 8/1979 |
| DE | 3527710 | 2/1987 |
| DE | 4424919 | 9/1995 |
| DE | 10060758 | 7/2001 |
| DE | 2142902 | 9/2004 |
| GB | 2014114 | 8/1979 |
| JP | 61-182798 | 8/1986 |
| JP | 2001341932 | 11/2001 |

* cited by examiner

TRANSPORT DEVICE

CROSS REFERENCE TO RELATED APPLICATIONS

This application is the U.S. National Phase, under 35 USC 371 of PCT/DE 03/00674, filed Feb. 28, 2003; published as WO 03/07440 A1 on Sep. 12, 2003 and claiming priority to DE 102 09 213.3, filed Mar. 4, 2002, the disclosures of which are expressly incorporated herein by reference.

FIELD OF THE INVENTION

The present invention is directed to a transport device. The transport device includes a conveying cylinder and a cooperating cylinder. The position of an end of a signature on the conveying cylinder can be changed.

BACKGROUND OF THE INVENTION

DE 100 80 758 A1, DE 28 05 643 A1 and U.S. Pat. No. 4,445,881 all disclose conveying cylinders in a folding apparatus. Shell surfaces of these conveying cylinders can be partially increased, in the radial direction, in order to affect a position of a signature on the cylinder.

CH 278 305 describes a folding apparatus. Spur needles can be moved to facilitate the cutting of shorter inserted sheets.

U.S. Pat. No. 4,445,881 shows a wheel folding apparatus with a folding blade and with a device for the partial increase of the barrel in the area of an end of a signature. The partial increase in the barrel is done to move this signature end away in the circumferential direction from a backstop for a cutting blade.

A collection cylinder is known from U.S. Pat. No. 5,765,459, whose spurs can be moved into various positions. In a first position of the spurs, a first signature is picked up. In a second position, a second signature is picked up.

SUMMARY OF THE INVENTION

The object of the present invention is directed to providing a conveying device.

In accordance with the present invention, this object is attained by the provision of a conveying device in a folding apparatus having a conveying cylinder for conveying signatures. At least one further cylinder cooperates with the conveying cylinder. A position of a trailing end of a signature conveyed by the conveying cylinder can be changed. The cylinder associated with the conveying cylinder may have a signature engaging strip and the conveying cylinder may have a cooperating groove. The conveying cylinder may have a holding device that can be changed in a circumferential direction. This holding device may have three positions. Both the strip and groove, and the holding device can be used together to change a signature position on the conveying cylinder.

The advantages to be gained by the present invention lie, in particular, in that it makes possible the simultaneous joining of a web of material with signatures which are already held on the conveying cylinder and which were cut off the same web or from another web of material. The cutting of the web of material brought in into individual signatures is accomplished without the danger of damage or the danger of again cutting the signatures already held on the conveying cylinder. Because the holding device of the cut-off signature moves the signature's edges out of the backstop area, a gap between two signatures, already previously separated from each other and placed on top of each other, is formed on the conveying cylinder at the height of the backstop, into which gap a cutting blade of the cutting cylinder can enter through and can cut the newly brought-in web, without there being a danger of a repeated cutting of the signatures already previously held on the conveying cylinder and already separated from each other.

In a first embodiment of the cutting device in accordance with the present invention, the gap is formed with the aid of a holding device for the signature, which holding device displaces the signature opposite to the signature conveying direction prior to reaching the second cutting gap and/or, following the passage of the signature through the second cutting gap, the holding device displaces the signature in the conveying direction. Such a holding device can be realized, in a simple manner, by a spur strip.

Another possible assembly, that is usable for moving the edges of the signature out of the backstop area, is a radially displaceable segment of the conveying cylinder which radially displaceable segment, following its passage through the first cutting gap, can be driven to perform a radially outward movement in order to increase the circumference of the conveying cylinder locally. In this way the assembly moves the trailing end of a cut product, which touches the displaceable segment, in the conveying direction out of the backstop area.

A further possibility for use in pulling a trailing edge of a signature forward is the application of a groove on the conveying cylinder and of a strip complementary thereto on the first cutting cylinder in such a way that the groove and the strip enter the cutting gap shortly prior to the cutting blade. By pushing the signature into the groove with the aid of the strip, the signature's trailing end is pulled forward a short distance. Furthermore, the signature cut off in this way, as well as the section of the web located on top of it, and to be cut off, are both strongly pushed against the conveying cylinder, which aids in the accuracy of the cutting process.

The cutting device in accordance with the present invention can be equipped with two cutting cylinders. The second cutting cylinder is used for cutting the signatures off the second web, which second web cut signatures are subsequently conducted through the first cutting gap, together with the first web. However, it is also possible to employ the cutting device with a single cutting cylinder and with a single web of material in a collection operation. Each signature then cut off the one web revolves once on the conveying cylinder and is covered, in the course of its second passage through the cutting gap, by a second signature. Both signatures together are then transferred to a further processing device by the conveying cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
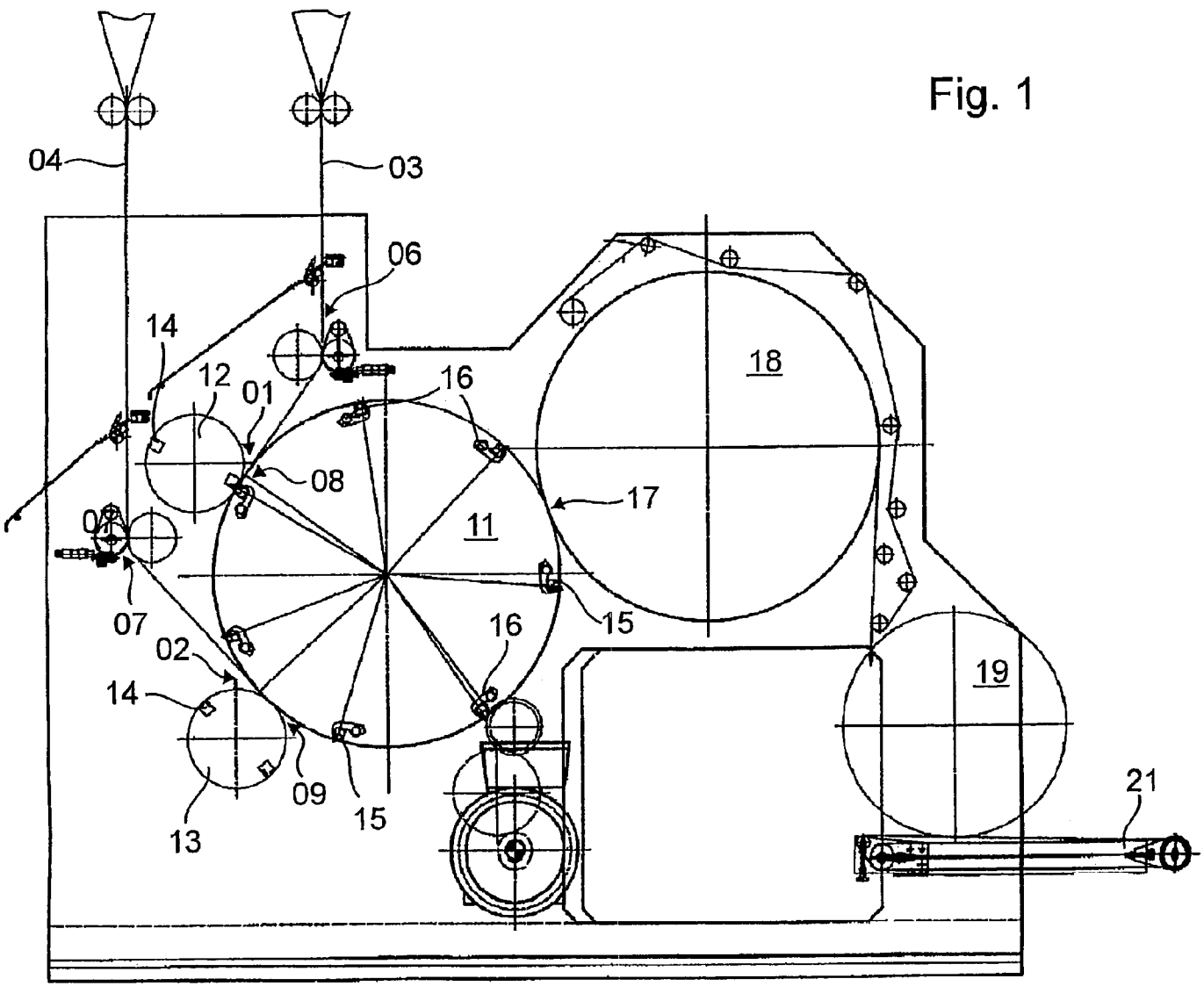
FIG. 1, a schematic side elevation view of a folding apparatus with a cutting device in accordance with the present invention, in FIG. 2 to 5, partial cross-sections of the conveying cylinder and of a cutting cylinder in different embodiments of the invention, in FIG. 6, a schematic depiction of a first mode of operation of the present invention, and in FIG. 7, a schematic depiction of another mode of operation.

A schematic side elevation view of a folding apparatus is represented in FIG. 1. This folding apparatus has two web inlets 01, 02 for the receipt of multi-layered webs 03, 04 of material, in particular paper webs 03, 04, which multi-layered webs 03, 04 will be hereinafter identified as the inner web 03 or as the outer web 04 in what follows. Both webs 03, 04 pass through a respective traction roller pair 06, 07, respectively for setting their tension and both webs then encounter a conveying cylinder 11 at the height of respective first and second cutting gaps 08, 09. These gaps are formed between the conveying cylinder 11, on the one hand, and one of cutting cylinders 12, 13 on the other hand. In place of two inlets 01, 02 and two cutting gaps 08, 09, it is also possible to provide three or more inlets and cutting gaps. In the course of this web travel, the webs 03, 04 preferably first come into contact with the respective cutting cylinder 12, 13 in each cutting gap 08, 09, respectively, and thereafter come into contact with the conveying cylinder 11. The webs 03, 04 thus first loop around the counter cylinder 12, 13 and then around the conveying cylinder 11.

Each one of the cutting cylinders 12 or 13 has a circumference corresponding to at least one, and preferably to two lengths of the signatures to be produced from the webs 03, 04. Each cutting cylinder supports two cutting blades 14.

The circumference of the conveying cylinder 11 corresponds to the length of more than five, and in particular to seven signatures. Seven counter-cutting strips, which are cut or inlaid into, and located at uniform spacing distances on the circumferential surface of the conveying cylinder 11, for example hard rubber strips, are used as backstops 15, each of which backstops is works together with a cutting blade 14 when these cutting blades 14 are cutting the webs 03, 04. A holding device 16, for example a spur strip 16, with spur needles 23, which spur strip 16 can be extended radially, as seen in FIGS. 2 to 5, is arranged on the conveying cylinder 11 adjoining each backstop 15.

In the position of the conveying or transporting device, as represented in FIG. 1, a cutting blade 14 of the cutting cylinder 12 and a backstop 15 of the conveying cylinder 11 are just passing through the first cutting gap 08 and, in the process, cooperate cut the inner web 03. The leading edge of the inner web 03 which is formed by this first cut, is spiked on the spur needles 23 of a spur strip 16, which spur strip 16 had been extended briefly prior to its reaching the cutting gap 08 and which also fixedly holds the inner web leading edge on the surface of the conveying cylinder 11 during further conveying.

The signature cut off the inner web 03 in this process is conveyed on by the conveying cylinder 11 to the second cutting gap 09, where the outer web 04 is placed on top of it and is also spiked by the spur needles 23 of the spur strip.

Figure 2:
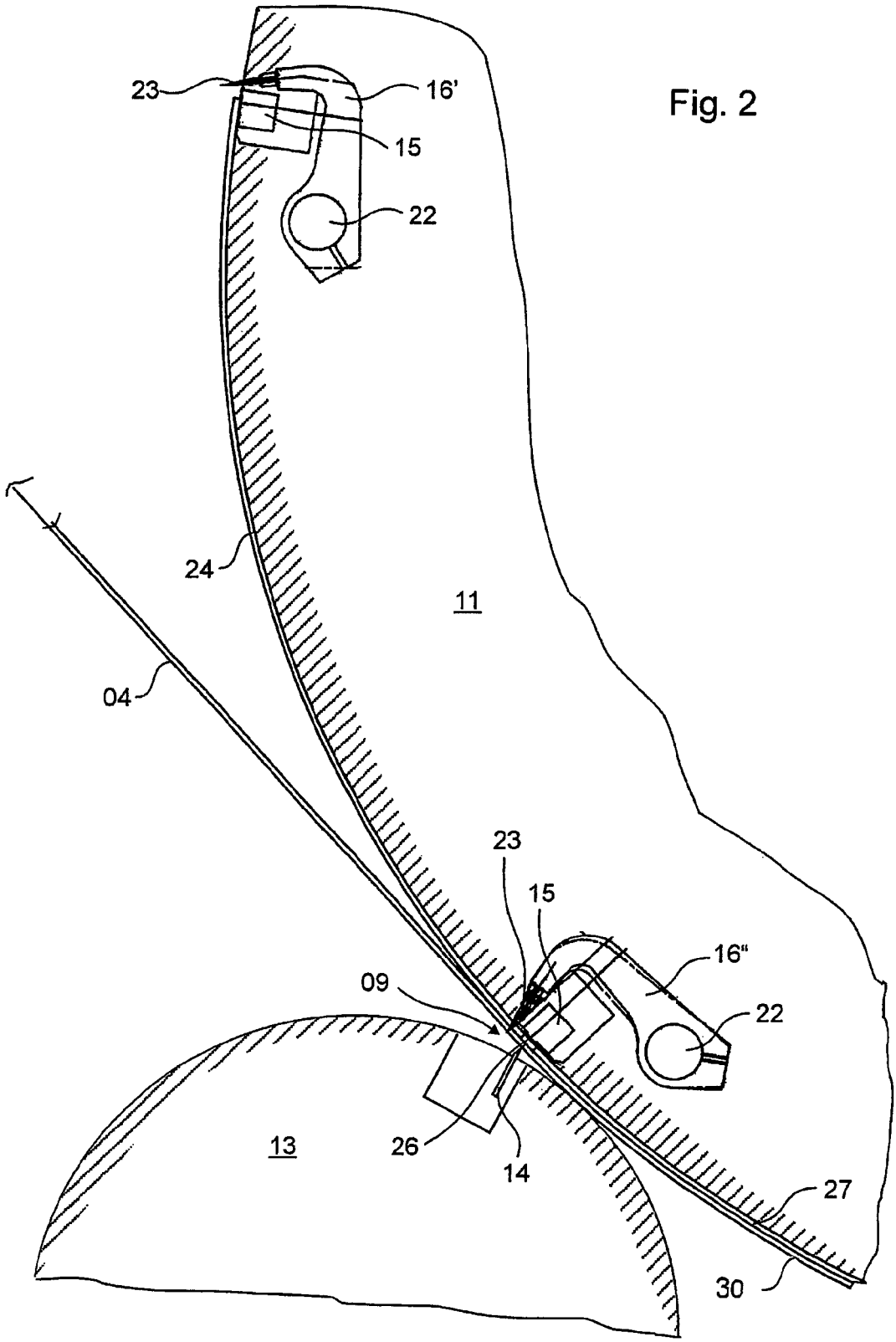

The rotation of the first and second cutting cylinders 12, 13 is synchronized in such a way that the two cutting blades 14 of each of the first and second cutting cylinders 12 and 13 always enter a narrow gap in the surface of the backstop 15, and ideally always strike the same line. During their passage through the second cutting gap 09, two successive signatures 24, 27, which were both cut off the inner web 03, are caused to be separated by a gap 26, as is shown in FIG. 2. The width of the inner signature separation gap 26 is slightly greater than that of the section of the backstop 15 into which the cutting blades 14 strike. The formation of gap 26 will prevent that, in the course of their passage through the cutting gap 09, these inner signatures 24, 27 being again cut. Different techniques for forming this gap 26 will be explained in the discussion which follows, and by reference to FIGS. 2 to 5.

In the configuration represented in the drawings, the angular distance between the two cutting gaps 08, 09 is approximately 75°. It is advantageous if this cutting gap angular distance differs from the angular distance of the spur strips 16 from each other, which spur strip angular distance is preferably 51.5°, or from a multiple thereof, so that cutting is not performed simultaneously at both cutting gaps 08, 09. A half-integral multiple of this value is also disadvantageous from the viewpoint of vibration avoidance.

Following its passage through the second cutting gap 09, each spur strip 16 supports a whole product, which is composed of a signature 24 cut off the inner web 03 and of a signature 27 cut off the outer web 04. Seven whole signatures, or products are formed in the course of every revolution of the conveying cylinder 11 in the same way as if both webs 03, 04 were fed via a common inlet 01, 02 in the customary way. However, since the cutting of each individual signature 24, 27 is spaced over two separate cutting steps at the first and second cutting gaps 08, 09, the force required to be provided in each cutting step is less. The result is that a satisfactory synchronous running of the machine is easier to maintain.

Furthermore, seven folding blades, which are not specifically represented in the drawing figure shown in FIG. 1, are attached to the conveying cylinder 11, each of which folding blades is extended when reaching a gap 17 between the conveying cylinder 11 and a folding jaw cylinder 18 in order to transfer the products 24, 27 conveyed by the conveying cylinder 11 to the folding jaw cylinder 18 in a manner that is known per se, and to thereby fold them. The folded products are then transferred from the folding jaw cylinder 18 to a bucket wheel 19 and are deposited by the bucket wheel 19 on a conveyor belt 21.

FIG. 2 shows a detailed view of a first preferred embodiment of the second cutting gap 09 and its surroundings in accordance with the present invention. Two of the seven spur strips 16 of the conveying cylinder 11 are represented in FIG. 2 and are indicated as first and second spur strips 16', 16", respectively. Spur strips 16', 16" are each pivotable around a shaft 22 in a controlled manner and each support spur needles 23 which are oriented in such a way that their tips can extend out of the circumference of the conveying cylinder 11 are each located farther away from the center of the shaft 22 than are their bases that are located in the interior of the conveying cylinder 11. The spur needles 23 of the first spur strip 16', as depicted in FIG. 2, are in a comparatively far or full extended position in which full extended position they previously had also passed through the cutting gap 08. This same position is shown in dashed lines at the location of the second spur strip 16".

In comparison with the first spur strip 16', the second spur strip 16" is shown in FIG. 2 as being pivoted back some distance farther into the interior of the conveying cylinder 11. This retraction pivot movement results in a displacement of the line of intersection between the spur needles 23 and the surface of the conveying cylinder 11 to opposite the direction of rotation of the conveying cylinder 11. Because of this displacement, the signature 24 held by the spur strip 16" has been slightly displaced on the circumferential surface of the conveying cylinder 11 opposite to the direction of rotation of the conveying cylinder 11 in comparison with the position in which inner signature 24 was cut off from the inner web 03 at the first cutting gap 08. After passing through the second cutting gap 09, the second spur strip 16" returns back into the original, extended position that is indicated by dashed lines, or even makes a transition to an even further extended position, in order to cancel, or to overcompensate for the prior retrograde displacement of the signature 24. In this way, a narrow gap 26 is initially formed between each signature 24 and a previous signature 27, which had been cut off immediately prior to it, into which narrow gap 26 the cutting blade 14 of the second cutting cylinder 13 can enter, and in this way the cutting device can push the outer web 04 against the backstop 15 and can cut it without risking the danger of again cutting one of the signatures 24, 27.

Figure 3:
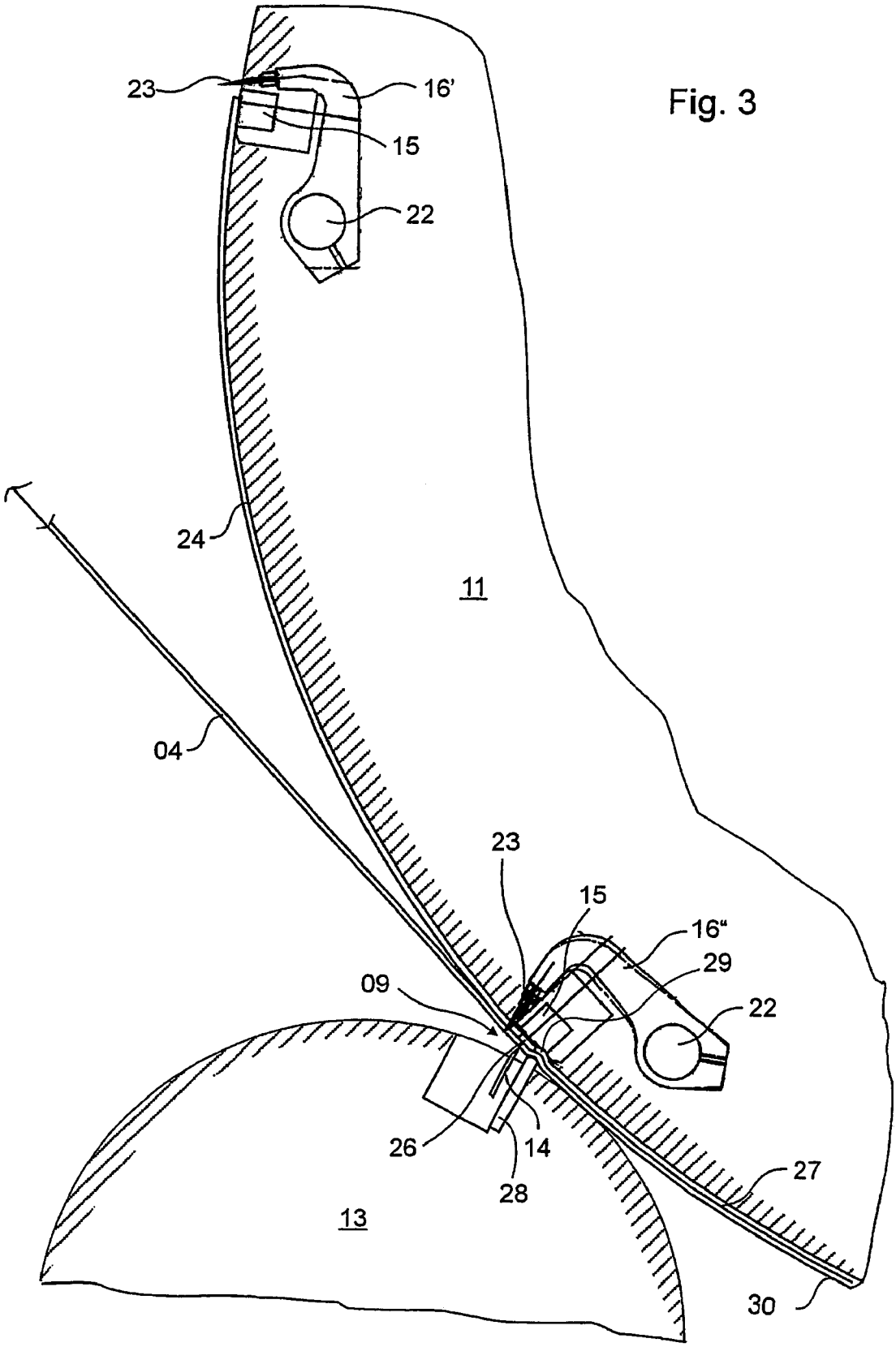

FIG. 3 shows an alternative embodiment of the conveying cylinder 11 and of the cutting cylinder 13 in a partial sectional view that is analogous to that of FIG. 2. With respect to each cutting blade 14, in this embodiment the cutting cylinder 13 has a strip 28 extending axially along, and projecting radially past its exterior circumference, which strip 28 passes through the cutting gap 09 shortly before the associated cutting blade 14. A complementarily shaped groove 29 is provided in the circumferential surface of the conveying cylinder 11 and is located opposite the strip 28 during each passage of strip 28 through the gap. The strip 28 pushes a trailing edge area of the inner signature 27 cut off the inner web 03, as well as the outer web 04, into the groove 29. The trailing end of the inner signature 27 is pulled forward by this and the signature spacing gap 26 is opened. With this embodiment it is therefore not necessary for the second spur strip 16" to be pivoted outward again after its passage through the second cutting gap 09 in order to form the signature spacing gap 26.

A third embodiment of the present invention is represented in FIG. 4, again by the use of a partial section through the conveying cylinder 11 and the second cutting cylinder 13. The second cutting cylinder 13 is identical to the second cutting cylinder 13 shown in FIG. 2. The conveying cylinder 11 of the third embodiment differs because of the arrangement of the shafts 22 around which the spur strips 16 can be pivoted. While in the embodiments of FIGS. 2 and 3, these shafts 22 are located ahead of the spur needles 23, in the direction of rotation of the conveying cylinder 11, these shafts 22 are arranged behind the spur needles 23 in the embodiment of FIG. 4. The orientation of the spur needles 23, in relation to the surface of the conveying cylinder 11, is the same in all cases. They are slightly inclined forward, opposite the normal surface, and in the direction of rotation of the conveying cylinder 11, so that a tension, acting on the material spiked on the spur needles 23, keeps the material pressed against the surface of the conveying cylinder 11.

Figure 4:
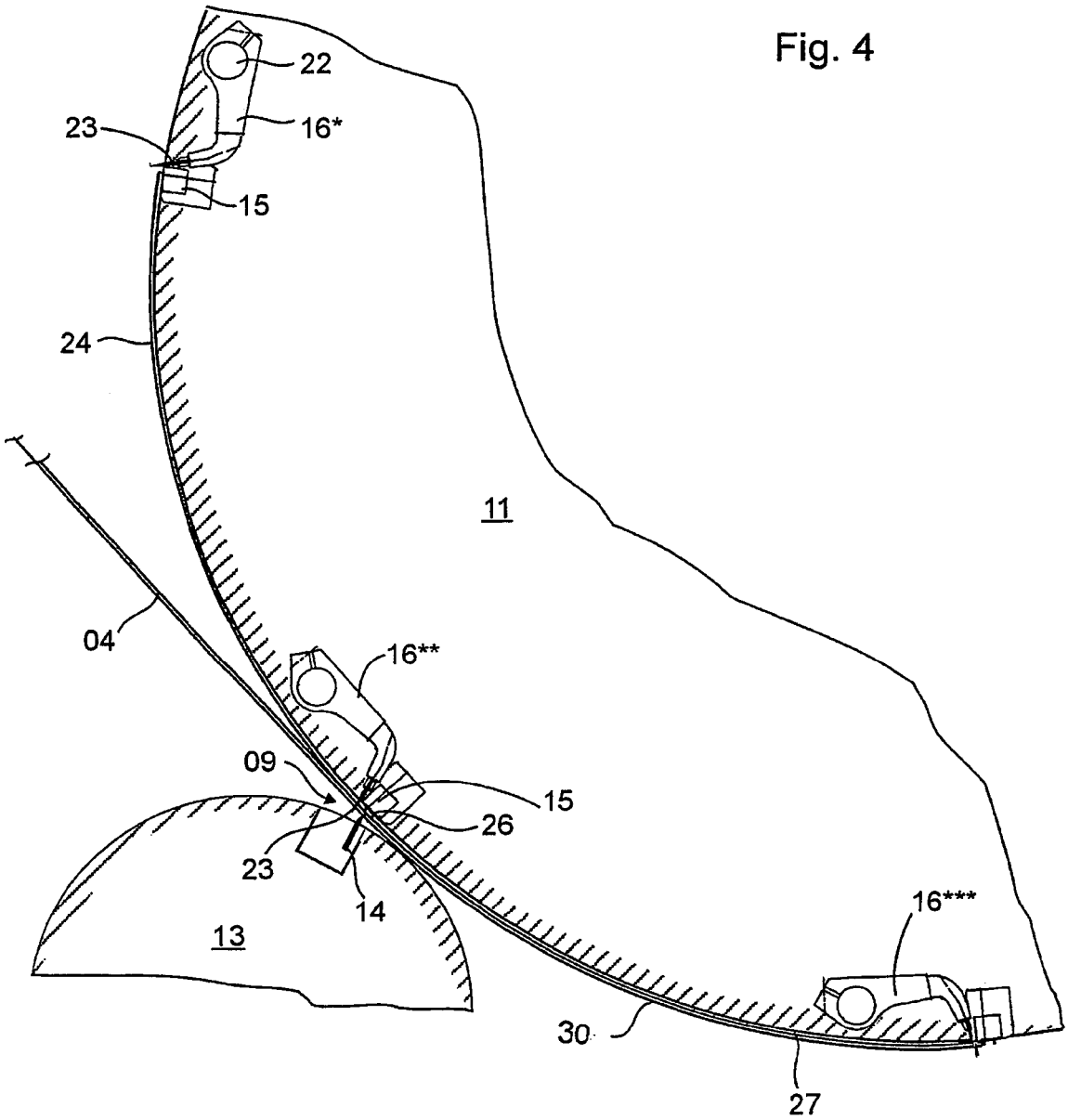
Figure 5:
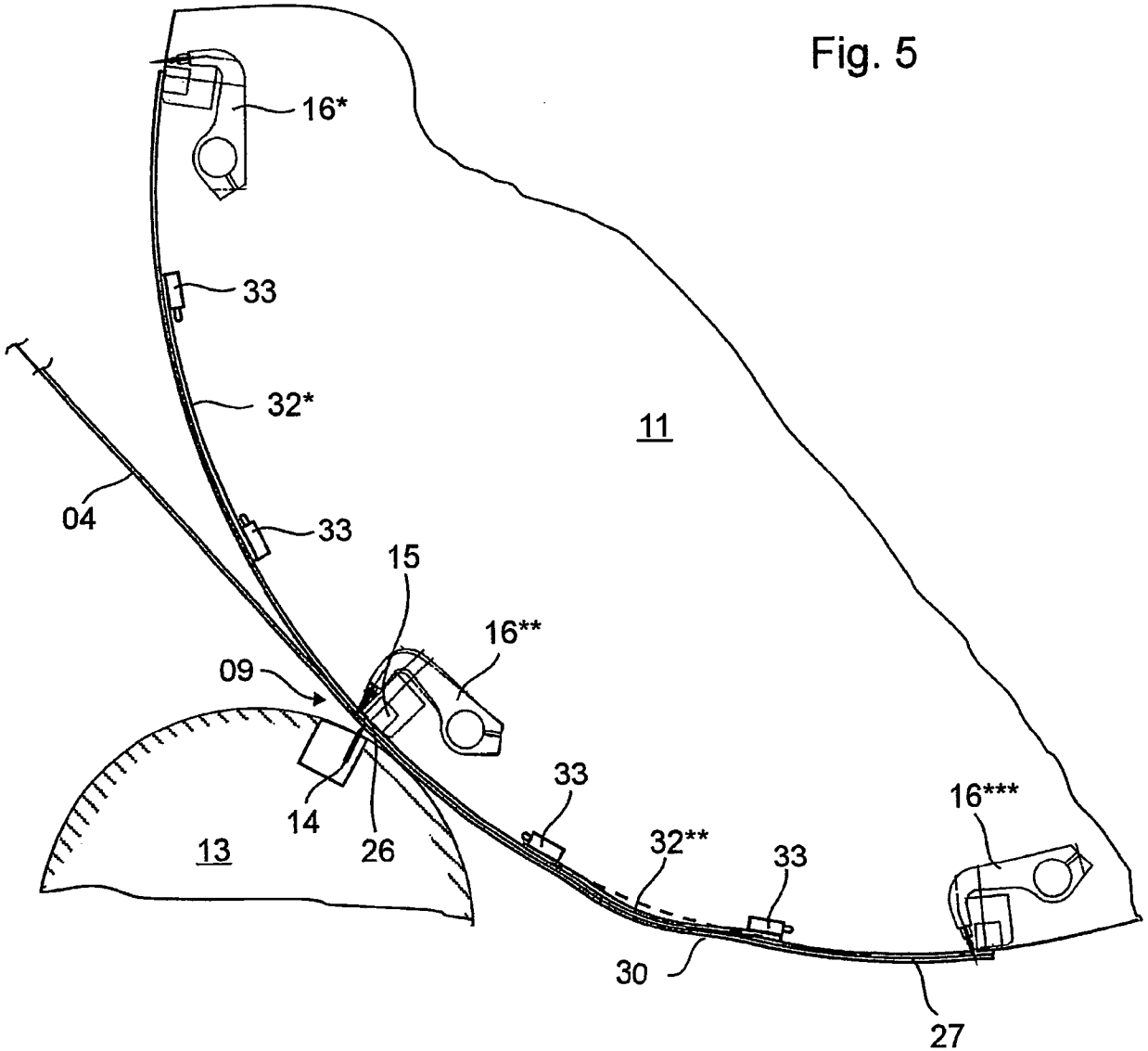

A changed sequence of the pivoting movement of the first and second spur strips, here identified as 16*, 16, results from the changed arrangement of the shafts 22 shown in FIG. 4. The first spur strip 16*, which is still far removed from the second cutting gap 09, is in a comparatively only slightly extended position, in which slightly extended position its spur needles 23 extend far enough past the circumference of the conveying cylinder 11 for holding an incoming inner web 03. The second spur strip 16** is shown as being farther extended only shortly prior to it reaching the cutting gap 09 for also now spiking the outer web 04, as can be seen by reference to the second spur strip 16**. In this third embodiment, the radially outward movement of the spur needles 23 causes a displacement of their intersection with the circumference of the conveying cylinder 11 in a direction opposite to the direction of movement of the conveying cylinder 11, and therefore a movement of the leading edge of the signature 24 held by the second spur strip 16** away from the impact point of the second cutting blade 14 on the backstop 15. The spur needles 23 of the third spur strip 16*** have now been retracted radially some distance farther back into the conveying cylinder 11 in order to move the signature 27, which they hold, forward in the circumferential direction and to open the gap 26 at the level of the backstop 15** in this way.

With this third embodiment, several directional changes in the movement of the spur needles 23, in the course of a revolution of the conveying cylinder 11, are avoided.

A fourth embodiment of the cutting device in accordance with the present invention is represented in FIG. 5, again in a partial sectional view that is analogous to FIG. 4.

In this fourth embodiment, first and second cylinder surface segments 32*, 32, as well as other similar segments, which are not specifically shown, are arranged on the circumference of the conveying cylinder 11 between each two of first, second and third successive spur strips 16*, 16**, 16*** . These segments 32*, 32** are utilized for increasing the circumference of the conveying cylinder 11. Each one of these segments 32*, 32**, is composed of a plurality of flexible plates, which are arranged side-by-side in the axial direction of the conveying cylinder 11 and which are also spaced apart axially by gaps 17. During the transfer of the finished cut signatures 24, 27 to the folding jaw cylinder 18, these axially spaced gaps 17, between axially adjacent segment 32*, 32** are used as respective outlet openings for tines of a folding blade, which is not specifically represented. The ends of the flexible plates are each anchored to top strips 33 which top strips 33 can be displaced in the circumferential direction of the conveying cylinder 11**.

The first cylinder surface segment 32* is in a configuration in which the course of its plates corresponds to the cylindrical shape of the conveying cylinder 11. After the passage of such a first segment 32* through the second cutting gap 09, its top strips 33 are displaced toward each other, for example in a motion that is controlled by a cam disk which is not specifically represented, so that its flexible plates, as indicated for the second segment 32, form a protrusion extending radially outwardly past the circumference of the conveying cylinder 11. As a result of this radially outwardly extending protrusion, the distance between the second and third spur strips 16** and 16*** , as measured along the surface of the conveying cylinder 11, is greater than the distance between the first and second spur strips 16* and 16**, the latter distance corresponding to the length of the signatures 24, 27 produced at the first cutting gap 08. Therefore, the bulging of the second cylinder surface segment 32** causes the formation of the gap 26 between the signatures 24 and 27, into which newly formed gap 26 the cutting blade 14 of the second cutting cylinder 13** can enter.

A modified embodiment of the cutting device of the present invention differs from the one represented in FIG. 1 in that the modified embodiment has only a single inlet 01, or 02 for a single web 03, or 04 to be cut. Reference is again made to FIG. 1 for its description, wherein the web 03 and the cutting cylinder 12 are assumed not to exist.

At the second cutting gap 09, the outer web 04, which has been conveyed via the second inlet 02 and which may be imprinted with alternating patterns A and B, meets the conveying cylinder 11, whose spur strips 16 alternatingly carry either a signature with the pattern A or no signature, when entering the second cutting gap 09. Since the number of spur strips 16 is an odd number, a free spur strip 16 meets a pattern A on the outer web 04 at the second cutting gap 09, and a spur strip 16, previously provided with a signature equipped with the pattern A in a prior rotation, meets a pattern B on the web 04. The signatures with the pattern A, which had already been held on the conveying cylinder 11, prior to their passage through the cutting gap 09, are each displaced, during their passage through the cutting gap 09, in one of the ways described above with reference to FIGS. 2 to 5, so that trailing ends of these signatures are not cut again during their second passage through the cutting gap 09.

Every time a spur strip 16, that is now carrying or holding two signatures A and B, passes the folding gap 17, the whole product obtained in this manner is transferred, in a manner that is generally known per se, to the folding jaw cylinder 18.

The second transverse cutting device 13 is arranged with a phase offset on the circumference of the conveying cylinder 11 for cutting.

The cut of the first transverse cutting device 12 on the cutting cylinder 11 takes place essentially next to the other cut of the second transverse cutting device 13, in particular within a distance of 10 mm next to it.

The first and second transverse cutting devices 12, 13 are arranged spaced from each other about the conveying cylinder 11 in the circumferential direction of the conveying cylinder 11.

In all modes of operation of the transport or conveying device in accordance with the present invention, a further conveying cylinder for taking over the signatures can be connected downstream of the first conveying cylinder 11, instead of the folding jaw cylinder 18, downstream of which further conveying cylinder a folding jaw cylinder or a belt system can be arranged.

Figure 6:
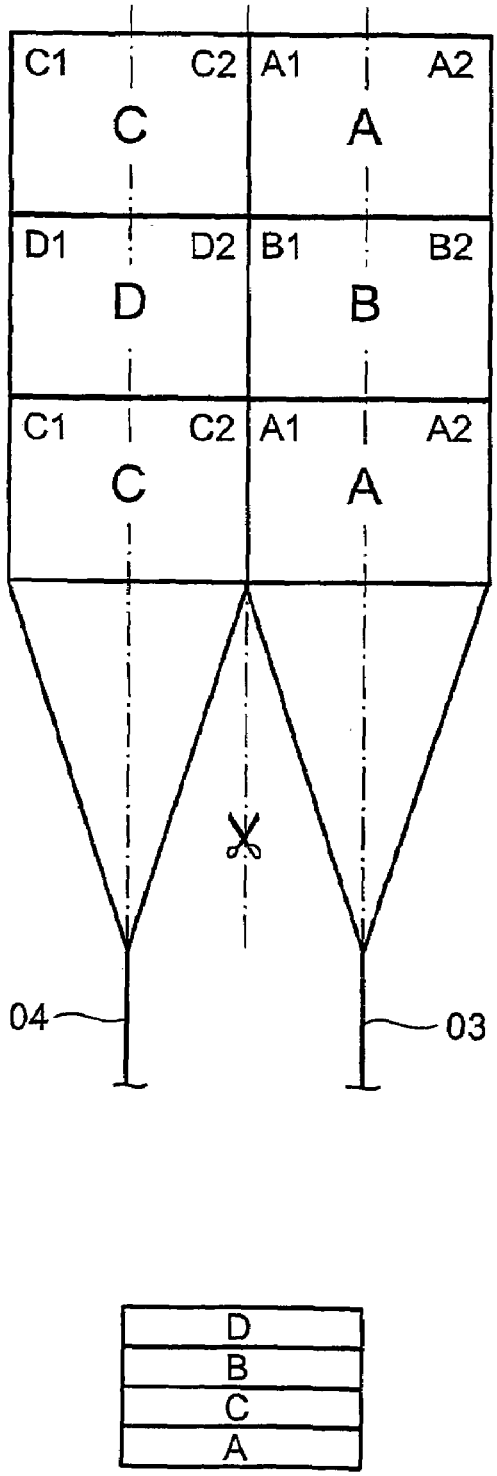

It is also possible for each of the webs 03, 04 to have the same patterns A or B located one behind the other, typically in the conveying direction as depicted at the right in FIG. 6. Preferably these patterns A and B are imprinted by the use of at least one formed cylinder of a printing unit, which at least one formed cylinder has two identical patterns A and B on its circumference. The webs 03, 04 are guided on top of each other, so that signatures with patterns A and B located on top of each other are formed, each of which web is transferred to the downstream located folding jaw cylinder 18 in the gap 17. The conveying cylinder 11 does not absolutely have to have an odd-numbered division for this, but instead can also have an even-numbered division, preferably greater than 4 or 6.

Preferably, each of the patterns A, B, C, D identifies two newspaper pages, wherein A1, A2, B1, B2, C1, C2, D1, D2 each identifies a newspaper page.

The identification of a web 03, 04 is understood to represent at least one web 03, 04, but preferably should be understood to be a representation of a strand consisting of several webs 03, 04 placed on top of each other.

Here, the webs 03, 04 can each be imprinted by the use of formed cylinders of printing units which either have a pattern A or B on the circumference, which is a single circumference, or two patterns A or B on the circumference, which is a double circumference. With double circumference formed cylinders, two identical patterns A, A, or B, B, or two different patterns A, B can be arranged on the circumference.

Therefore, four modes of operation of the transport or conveying device in accordance with the present invention are possible.

In a first and in a second mode of operation, both webs 03, 04 are brought together on the conveying cylinder 11 ahead of the first inlet 01, or ahead of the second inlet 02 and are together severed in the course of a single cutting operation.

In this case, in a first mode of operation, the webs 03, 04 have identical patterns A or C in sequence, and the same products are formed sequentially on the conveying cylinder 11 during each revolution of conveying cylinder 11 and are directly transferred to the downstream located folding jaw cylinder 18.

In the second mode of operation, the webs 03, 04 have patterns A, B or C, D, which patterns alternate behind each other and which patterns are alternatingly deposited on the conveying cylinder 11 during a first revolution of the conveying cylinder 11, which conveying cylinder 11 is here provided with an odd number of fields and is thus a collection cylinder, and the signatures or products are additionally provided with a second layer of the product portion during the second revolution.

In a third and fourth mode of operation, two webs 03, 04 are separately fed in, wherein, in the third mode of operation, the webs 03, 04 alternatingly bear the patterns A, B or C, D located one behind the other as may be seen in FIG. 6.

In this third mode, during a first revolution of the conveying cylinder 11, which is again acting as a collection cylinder, first signatures with the pattern A, C of each web 03, 04 are conducted on all and on every second spur strip 16, so that now every second spur strip 16 carries a signature with the pattern A, C. During the second revolution of the conveying cylinder 11 again two signatures with the pattern B, D from each web 03, 04 are conducted on the spur strips 16.

Therefore, during the second revolution of the conveying cylinder 11, signatures A, C, B, D on the spur strips 16 alternate with spur strips 16 carrying only signatures with the patterns A, C, The already completely collected signatures, i.e. the product with the pattern A, B, C, D of each second field, are transferred to the folding jaw cylinder 18.

Figure 7:
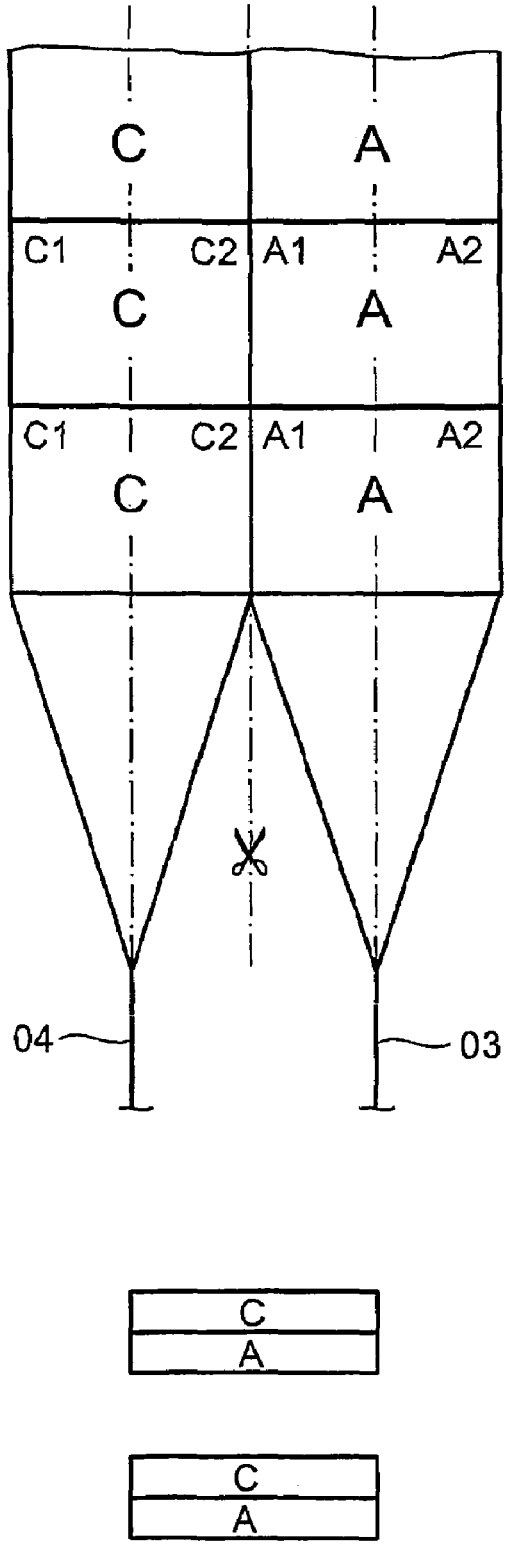

In a fourth mode of operation, the webs 03, 04 have identical patterns A, A, or C, C located behind each other as seen in FIG. 7, so that, with each revolution of the conveying cylinder 11, each spur strip 16 carries a product with signatures with the pattern A, C, which products are directly transferred to the folding jaw cylinder 18 when they arrive there.

While preferred embodiments of a transport or conveying device, in accordance with the present invention, have been set forth fully and completely hereinabove, it will be apparent to one of skill in the art that various changes in, for example the printing cylinder and the like could be made without departing from the true spirt and scope of the present invention which is accordingly to be limited only by the following claims.

What is claimed is:

1. A conveying device in a folding apparatus comprising:

a conveying cylinder adapted to convey signatures having leading and trailing signature ends;

at least one further cylinder cooperating with said conveying cylinder and defining a cylinder gap, said further cylinder having a circumferential surface;

at least one signature trailing end displacement strip extending axially on said further cylinder and projecting radially past said circumferential surface of said further cylinder;

a signature trailing end displacement strip receiving groove on said conveying cylinder and located opposite said signature trailing end displacement strip as said strip passes through said cylinder gap, said signature trailing end displacement strip receiving groove being adapted to receive said signature trailing end strip, said signature trailing end displacement strip contacting said trailing ends of signatures passing through said cylinder gap and displacing said trailing ends of signatures conveyed on said conveying cylinder into said signature trailing end displacement strip receiving gap and in a circumferential direction of said conveying cylinder to form a signature spacing gap; and a signature leading end holding device on said conveying cylinder and adapted for movement in a radial direction of said conveying cylinder into engagement with said leading ends of signatures conveyed on said conveying cylinder.

2. The conveying device of claim 1 wherein said at least one further cylinder is a cutting cylinder having at least one cutting blade.

3. The conveying device of claim 1 wherein said signature leading end holding device is also movable in said circumferential direction of said conveying cylinder, said displacement of said signature trailing end in said circumferential direction also being in response to said movement of said signature leading end holding device in said circumferential direction.

4. The conveying device of claim 3 wherein, in a first position, said signature leading end holding device is arranged at a radially inner position.

5. The conveying device of claim 3 wherein, in a second position, said signature leading end holding device is arranged at a radially outer position.

6. The conveying device of claim 1 wherein said at least one signature trailing end displacement strip is fixed in place on said further cylinder.

7. The conveying device of claim 1 wherein said signature leading end holding device on said conveying cylinder is adapted to change a position of said leading end of the signature.

8. The conveying device of claim 7 wherein said signature leading end holding device and said signature trailing end displacement strip act on a signature at different times.

9. The conveying device of claim 7 wherein said signature leading end holding device is a spur strip.

* * * * *